United States Patent [19]

Bizzarri

[11] 4,021,770

[45] May 3, 1977

[54] ELECTRICAL RESISTANCE ELEMENT

[75] Inventor: Venanzio Bizzarri, Hallstahammar, Sweden

[73] Assignee: Bulten-Kanthal Aktiebolag, Sweden

[22] Filed: Sept. 8, 1975

[21] Appl. No.: 610,930

Related U.S. Application Data

[63] Continuation of Ser. No. 460,894, April 15, 1974, abandoned.

[52] U.S. Cl. ..... 338/332; 219/118; 361/264

[51] Int. Cl.[2] ..... H01C 1/148

[58] Field of Search ..... 317/98; 338/332; 219/118

[56] References Cited

UNITED STATES PATENTS

| | | | |
|---|---|---|---|
| 2,745,928 | 5/1956 | Glaser | 338/332 |
| 2,883,518 | 4/1959 | Zabka et al. | 219/118 |
| 2,937,262 | 5/1960 | Baxter | 219/118 |
| 3,813,643 | 5/1974 | Hartz | 338/332 |

*Primary Examiner*—Elliot Goldberg
*Attorney, Agent, or Firm*—Hill, Gross, Simpson, Van Santen, Steadman, Chiara & Simpson

[57] ABSTRACT

An electrical resistance element with electrode portions comprising a thin resistance wire of a heat resistant material, such as molybdenum disilicide, $MoSi_2$, which resistance wire has at least one end electrode of aluminium, having a much greater cross-sectional area than that of the resistance wire, wherein the end portion of the resistance wire is fused into the end portion of the respective electrode portion.

Also disclosed is a method of connecting an electrode portion to one end of the resistance wire in an electrical resistance element by placing the end portion of the electrode within a surrounding sleeve, heating the sleeve with the electrode end therein to cause the outermost end portion of the electrode end to form a melt, introducing the resistance wire end into the melt and permitting the melt to solidify and finally removing the electrode and resistance wire connected thereto from the sleeve.

2 Claims, 1 Drawing Figure

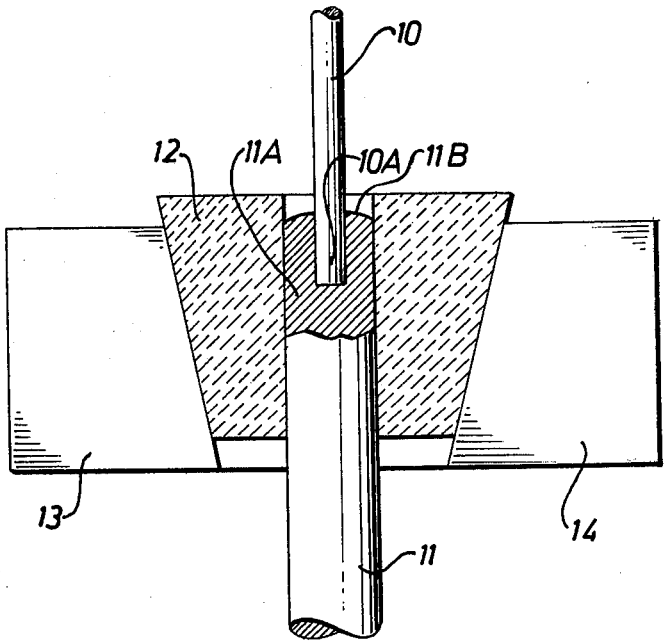
10
12
11A
10A
11B
13
14
11

ELECTRICAL RESISTANCE ELEMENT

This is a continuation of application Ser. No. 460,894, filed Apr. 15, 1974 now abandoned.

FIELD OF THE INVENTION

This invention relates to electrical resistance elements comprising a thin resistance wire, made of a highly heat resistant material, and, at at least one end of said resistance wire, an electrode portion having a higher electrical conductivity than that of the resistance wire.

BACKGROUND OF THE INVENTION

Thin electrical resistance elements of the class to which the present invention pertains, either as being used as ignitors, sensing elements or for other purposes, may consist of an e.g. hair-pin shaped, omega shaped or helicoidal rather thin resistance wire of the material which is sold under the registered trade mark "KANTHAL SUPER" and which essentially consists of molybdenum disilicide, $MoSi_2$. The ends of the resistance wire are provided with electrode portions which have a greater cross-sectional area than that of the resistance wire and consist of a suitable material, such as aluminum, for instance. The electrode portions are connected to the ends of the resistance wire by brazing which operation is time consuming and elaborate to carry out. Further, residues of the flux agent and oxidation products from the brazing agent may lead to such strong attacks on the resistance wire by corrosion that ruptures occur.

OBJECTS OF THE INVENTION

One important object of the present invention is to provide an electrical resistance element of the class generally described above wherein the drawbacks of the prior art electrical resistance elements are obviated.

A more specific object of the invention is to provide an electrical resistance element comprising a thin heat resistant resistance wire which has, at at least one end thereof, an electrode portion which is connected to the resistance wire by fusing so as to avoid contamination by flux agents or brazing agents.

THE INVENTION

According to the invention there is provided an electrical resistance element with electrode portions comprising a thin resistance wire of a highly heat resistant material, preferably essentially consisting of molybdenum disilicide, $MoSi_2$, which resistance wire has, at at least one end thereof, an electrode portion of a higher electrical conductivity than that of the resistance wire, preferably a cylindrical electrode of aluminium, having a much greater cross-sectional area than that of the resistance wire, wherein the end portion of the resistance wire is fused into the end portion of the respective electrode portion.

In the drawing:

The single FIGURE in the drawing shows schematically and partly in axial section a connection of one end of an electrical resistance wire to an end portion of an electrode.

DESCRIPTION OF PREFERRED EMBODIMENT

In the drawing there is illustrated one end 10 of a thin electrical resistance element of a material sold under the registered trade mark "KANTHAL SUPER", i.e. a material essentially consisting of molybdenum disilicide, $MoSi_2$. The general shape of the resistance wire has no bearing on the invention, and the exact cross-sectional shape of the resistance wire per se is similarly of no importance for the invention. However, normally, the resistance wire has a circular cross-section, and the diameter thereof may be of the order of about 0.4 millimeters or even slightly less.

The resistance wire end 10 is shown as being connceted to an electrode 11 the cross-sectional area of which is much greater than that of the resistance wire. The dimension of the electrode 11 is adapted to that of the resistance wire, and, normally, the diameter of the electrode is of the order of 1.5 to 3.0 millimeters. In the example shown the electrode 11 comprises aluminum or a similar material. In the drawing the end portion of the electrode 11 is shown as surrounded by a sleeve 12 the internal shape of which is adapted to the external shape of the electrode end and which sleeve 12 comprises graphite or a similar material.

More particularly, the material of the sleeve 12 should be chosen so that molten electrode material does not adhere to the inner surface of the sleeve 12, and, further, the material of the sleeve 12 should preferably be chosen such as to exhibit a smaller coefficient of thermal expansion than that of the electrode material.

When the resistance wire is to be equipped with its electrodes, the electrode end 11 is introduced into the sleeve 12 which serves as a crucible, the bottom of which is formed by the electrode end 11. Then, the sleeve 12 is heated, e.g. by means of a flame or by a direct through-passing of electrical current, to such an extent as to cause at least the outermost end portion 11A to melt. Following the heating the outermost end portion 10A of the resistance wire 10 is inserted into the molten electrode end portion 11A which is the allowed to cool down and solidify to form a solidification of the electrode material on the wire 10. Finally, the sleeve 12 is removed. If desired, the outermost end portion 10A of the resistance wire 10 may be pretreated by etching, such as by etching in hydrofluoric acid for about 10 seconds.

In the example shown in the drawing the sleeve 12 is conically tapering downwardly, and the height thereof is about 8 millimeters. At the beginning of the connecting operation the electrode 11 is introduced into the sleeve 12 to such an extent that there is left upwardly a space of a height of about 2 millimeters to accommodate the aluminum melt which rises slightly within the sleeve during the melting and connection procedure, as has been indicated at 11B.

Further, in the drawing, the sleeve 12 has been placed between two jaws 13, 14, the opposing surfaces of which are adapted to the conical shape of the sleeve, and which jaws are electrically insulated from each other. During the connecting procedure electric current may be passed through the jaws 13, 14 and, consequently, through the sleeve 12, so that the sleeve is heated sufficiently to cause a melting of the electrode end portion 11A.

I claim as my invention:

1. An electrical assembly, comprising:

a. an electrical resistance element comprising a small diameter wire consisting essentially of molybdenum dicilicide;

b. a cylindrical electrode having a connection with said wire and disposed in end-to-end relation therewith with their axes parallel, said electrode having a larger diameter between 1.5 and 3.0 mm and having higher conductivity than said wire; and c. said connection comprising a solidified molten outermost end portion of only the electrode material surrounding the end of said wire in tightly gripping and electrically conducting engagement therewith

2. An electrical connection according to claim 1 in which said electrode comprises aluminum.

* * * * *